US010361024B2

(12) United States Patent
Hanov

(10) Patent No.: US 10,361,024 B2
(45) Date of Patent: Jul. 23, 2019

(54) DRY-TYPE TRANSFORMER CORE

(71) Applicant: SIEMENS AKTIENGESELLSCHAFT, Munich (DE)

(72) Inventor: Rudolf Hanov, Weilheim (DE)

(73) Assignee: Siemens Aktiengesellschaft, Munich (DE)

( * ) Notice: Subject to any disclaimer, the term of this patent is extended or adjusted under 35 U.S.C. 154(b) by 187 days.

(21) Appl. No.: 15/510,912

(22) PCT Filed: Sep. 16, 2015

(86) PCT No.: PCT/EP2015/071235

§ 371 (c)(1),
(2) Date: Mar. 13, 2017

(87) PCT Pub. No.: WO2016/050515

PCT Pub. Date: Apr. 7, 2016

(65) Prior Publication Data

US 2017/0271070 A1 Sep. 21, 2017

(30) Foreign Application Priority Data

Sep. 29, 2014 (EP) ..... 14186803

(51) Int. Cl.

| | |
|---|---|
| ***H01F 27/24*** | (2006.01) |
| ***H01F 27/23*** | (2006.01) |
| ***H01F 27/25*** | (2006.01) |
| ***H01F 27/02*** | (2006.01) |
| *H01F 3/00* | (2006.01) |
| *H01F 27/32* | (2006.01) |

(52) U.S. Cl.

CPC ..... *H01F 27/23* (2013.01); *H01F 27/022* (2013.01); *H01F 27/24* (2013.01); *H01F 27/25* (2013.01); *H01F 3/00* (2013.01); *H01F 2003/005* (2013.01); *H01F 2027/328* (2013.01)

(58) Field of Classification Search

CPC ..... H01F 27/00–36
USPC ..... 336/65, 83, 90, 92, 96, 212, 206–208, 336/233–234

See application file for complete search history.

(56) References Cited

U.S. PATENT DOCUMENTS

2011/0248808 A1 10/2011 Singh et al.
2013/0162386 A1 6/2013 Singh et al.

FOREIGN PATENT DOCUMENTS

WO 2011107387 A1 9/2011

*Primary Examiner* — Tuyen T Nguyen
(74) *Attorney, Agent, or Firm* — Laurence Greenberg; Werner Stemer; Ralph Locher

(57) ABSTRACT

A dry-type transformer core has an iron core with a number of limbs designed to be wrapped with a winding and interconnected by a number of magnetic yokes. The object is to produce a transformer of this type in a simple manner, which is especially well protected against corrosion. For that purpose, the dry-type transformer core includes a casing that is formed onto the iron core. The casing surrounds the iron core in a substantially flush manner.

19 Claims, 3 Drawing Sheets

DRY-TYPE TRANSFORMER CORE

BACKGROUND OF THE INVENTION

Field of the Invention

The invention relates to a dry-type transformer core, comprising an iron core having a number of limbs which are configured to be provided with a winding and are connected to one another by a number of yokes.

A dry-type transformer is a transformer which does not contain any liquid insulating substances, such as transformer oil. Dry-type transformers are conventionally used as power transformers—in particular, as such, in electrical energy grids. They are therefore frequently in a three phase design as three-phase alternating current transformers. Dry-type transformers are used in particular in situations in which, owing to the spatial proximity to persons or material assets, oil-filled transformers cannot be installed, or can only be installed with considerable fire-prevention measures such as fire barriers. Oil collection pits for groundwater protection are also omitted.

As with liquid-filled transformers, dry-type transformer cores are conventionally designed as two-limb or three-limb iron core transformers comprising insulated electric sheets on both sides. The limbs, which are provided with coil windings, are connected to one another on both sides here by yokes. As a result of using thin electric sheets for producing the core, this has to be held, fastened and pressed at different points. This has hitherto been achieved by bandaging, screwing and pressing. If very thin amorphous sheets are used, the mechanical stabilizing of the core is even more complex.

If dry-type transformer cores are to be operated outdoors, in water or under water, special corrosion-preventing measures have to be provided for the entire transformer or, if installed without a protective housing, for the iron core. Owing to the geometric shape of the iron core, a complex coating is required here to ensure the corrosion prevention since the core is not surrounded by oil.

SUMMARY OF THE INVENTION

It is therefore the object of the invention to provide a dry-type transformer core of the type mentioned at the outset which, on the one hand, is particularly easy to manufacture and, on the other, is particularly well protected against corrosion.

This object is achieved according to the invention in that the dry-type transformer core comprises a housing which is integrally formed on the iron core and surrounds the iron core in a substantially flush manner.

The invention takes as a starting point here the consideration that both of the above-mentioned objects could be achieved by a housing which, on the one hand, ensures the mechanical strength of the iron core in that it surrounds it in a flush manner, i.e. so that the individual electric sheets are held in their position with form fit by the housing and, on the other, ensures good corrosion prevention through complete encapsulation.

To prevent the housing from having a negative influence on the magnetic properties of the transformer, it is advantageously made of a non-magnetic material.

In particular, the non-magnetic housing advantageously has a mean relative permeability between −1.01 and 1.01, preferably between −1.001 and 1.001. Relative permeability refers here to the ratio of permeability (ratio of the magnetic flux density to the magnetic field strength) of the housing to that of the vacuum. The housing is therefore advantageously made of a material whereof the permeability corresponds as far as possible to that of the vacuum.

To also prevent the magnetic properties of the transformer from being negatively influenced as a result of too great a spacing of the windings surrounding the housing from the actual iron core, the wall thickness of the housing is advantageously less than 1 cm. The wall thickness refers here to the spacing of the outer face of the housing from the outer face of the iron core.

In an advantageous development of the dry-type transformer core, the housing is predominantly made of a plastic material. Plastic material refers here to an organic polymeric solid body, which is synthetically or semi-synthetically manufactured from monomeric organic molecules or biopolymers. Plastic materials generally fulfill the requirement of non-magnetizability, are easy to shape and have sufficient stability.

In an alternative advantageous development of the dry-type transformer core, the housing is predominantly made of steel. Non-magnetic steels such as chrome-nickel steels, which have an appropriate relative permeability, are used here. Steels of this type are also comparatively flexibly shapeable and have the necessary strength for stabilizing the iron core. Steels are moreover electrically conductive so that excessive electric field strengths are reduced, in particular when the housing has a rounded design.

The housing is advantageously also grounded here.

In a further advantageous development of the dry-type transformer core, the housing is constructed from a plurality of parts, wherein one of the parts substantially surrounds one of the yokes. All in all, the housing should be designed so that the iron core can be inserted, mounted and assembled in its individual sections. In particular, the housing is constructed here so that coils can be guided over the individual iron core limbs and their housing part and then a yoke can be applied. This is in turn surrounded by appropriate housing parts.

The housing advantageously has a number of fastening devices on its outside. This can comprise both the fastening devices for the installation of the transformer itself and for fastening the windings.

The iron core here advantageously consists of amorphous films. Specifically in the case of such iron cores which, without a housing, have to be stabilized in a particularly complex manner and in which fastening is particularly difficult to execute, the use of a housing with appropriate fastening devices is especially advantageous.

A somewhat larger design of the housing results in a clearance remaining between the iron core and the housing, so this is advantageously filled with a suitable mass. This increases the stability of the transformer core produced.

The housing advantageously comprises an insulating part, which is designed in such a way that no closed conductor loops occur around the iron core. In the case of an electrically conductive housing, it is necessary to develop this with a non-conductive gap which can be arranged in practically any way and only has to be topologically expanded and arranged such that no closed loops can be formed around the iron core. Short-circuit windings are thereby namely prevented. The gap can also be made of a suitable insulating material.

A dry-type transformer advantageously comprises a dry-type transformer core as described and a number of coils wound around the limbs which are surrounded by the housing.

A dry-type transformer designed in the manner mentioned above is advantageously configured for a nominal voltage of greater than 1 kV and/or a nominal power of greater than 50 kVA. Specifically in the case of dry-type transformers in this power class, the above-described housing of the iron core is of considerable advantage in terms of the construction.

The dry-type transformer here is advantageously configured as a cast resin transformer, i.e. the insulation of the high-voltage windings consists of cast resin.

The advantages achieved by the invention consist in particular in that the mechanical strength of the dry-type transformer core is ensured as a result of integrating the iron core in a non-magnetic housing acting as a supporting component, without the need for complex core bandages, core screw connections or core pressing devices. A completely encapsulated iron core is produced, which is protected against corrosive influences. The noise level is moreover reduced since this is generated substantially by the magnetostriction of the iron core, which is shielded by the housing.

The shape of the housing can follow the shape of the iron core and can also be manufactured for circular, oval or rectangular iron-core cross-sections. The assembly of the housing can take place using all known joining processes, taking into account an insulating point.

BRIEF DESCRIPTION OF THE SEVERAL VIEWS OF THE DRAWING

Exemplary embodiments of the invention are explained in more detail with reference to a drawing, which shows.

DESCRIPTION OF THE INVENTION

Figure 1:
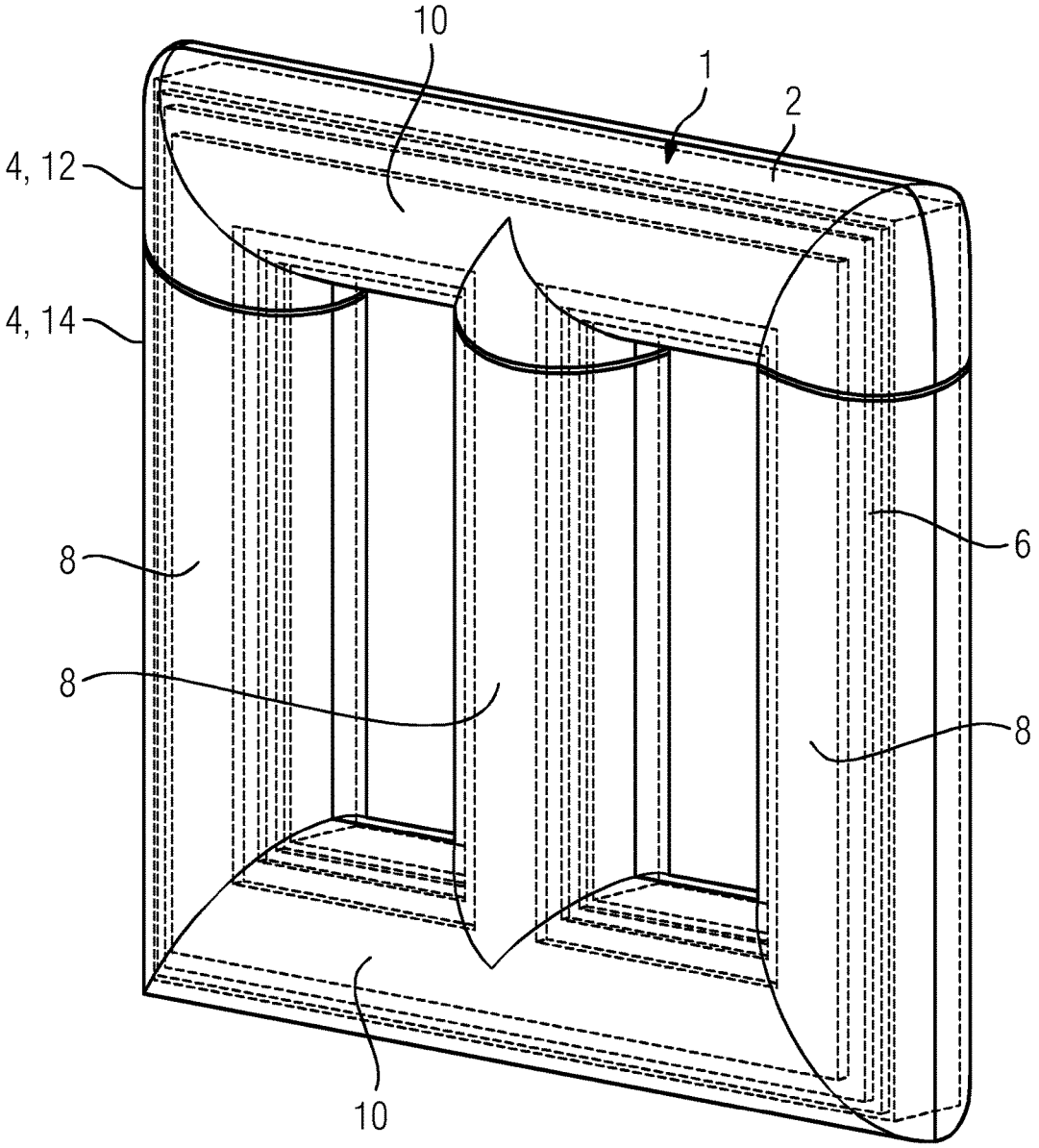
FIG. 1 a dry-type transformer core having a rounded housing which surrounds the iron core.

The same parts are provided with the same reference numerals in all of the figures.

All of the figures described below show dry-type transformer cores 1 which are configured for cast resin transformers having a nominal voltage of greater than 1 kV and/or a nominal power of greater than 50 kVA and therefore have a corresponding size. They are particularly suitable as power transformers in electrical energy grids. The common features of the three figures are firstly described below.

The dry-type transformer cores 1 shown have an iron core 2 comprising electric sheets in laminated form. In other exemplary embodiments, the core is composed of amorphous films. It is illustrated by dashed lines in all of the figures since it is located inside the housing 4. The dimensions of the electric sheets diminish in height and width with respect to the edge of the iron core 2 so that, when the electric sheets are stacked above one another, steps 6 are produced as a result of the diminishing dimensions in each lamination. A somewhat rounded shape of the iron core 2 is achieved in this way. In other embodiments (not shown), it can also be economical to have a rectangular core cross-section without the edges being rounded, e.g. in the case of amorphous sheets.

Transformers are essentially differentiated by the terms "shell type" and "core type". In both types, the windings encompass a common iron core 2. If the winding and the iron core 2 are surrounded by outer iron paths, or the majority of the conductive windings, which can consist for example of copper or aluminum, are surrounded by iron, this refers to shell transformers. However, the dry-type transformer cores 1 shown in the figures are configured for core transformers.

The limbs 8 (also main limbs) to be provided with windings are connected to one another here at their ends by yokes 10. The type of transformer core is indicated in a code consisting of two numbers. The first number describes the number of limbs 8 provided with windings, the second describes the number of return limbs (this refers to outer limbs in the case of a shell transformer which are not provided with windings).

All of the figures each show a 3/0 dry-type transformer core 1, i.e. a three-limb dry-type transformer core 1 without a return limb, the three limbs 8 of which are to be provided with a winding. However, the exemplary embodiments are only referred to by way of example; the housing illustrated here with all the properties described may also be manufactured for any other configurations.

The housing 4 is made of a non-magnetic material in all of the figures, i.e. a material having a relative permeability in the range between −1.01 and 1.01. A plastic material can be used for this in some exemplary embodiments, or chrome-nickel steel can also be used for this in other exemplary embodiments.

In the figures, the housing 4 is integrally formed on the iron core 2 in a flush manner in each case, i.e. it is designed so that it holds the iron sheets of the iron core 2 together with form fit. It surrounds the iron core 2 completely, i.e. it encapsulates it. The housing 4 here has a wall thickness in each case of less than 1 cm, i.e. a few mm. An empty space remaining between the iron core 2 and the housing 4 is filled with a suitable material. The housing 4 is constructed from a plurality of parts in each case: firstly a first part 12 is provided, which surrounds the upper yoke 10, and a second part 14 is provided which surrounds the limbs 8 and the lower yoke 10.

Both parts 12, 14 are in turn composed in two parts as half shells so that, in the manufacturing process, the iron core 2 can be inserted into the first half shell and the second half shell can then be connected to the first half shell for stabilization purposes.

The differences between the exemplary embodiments in the different figures are explained in more detail below.

FIG. 1 shows a dry-type transformer core 1 having a housing 4 with a circular cross-section over the yokes 10 and limbs 8. It follows the outer contour of the iron core 2.

Figure 2:
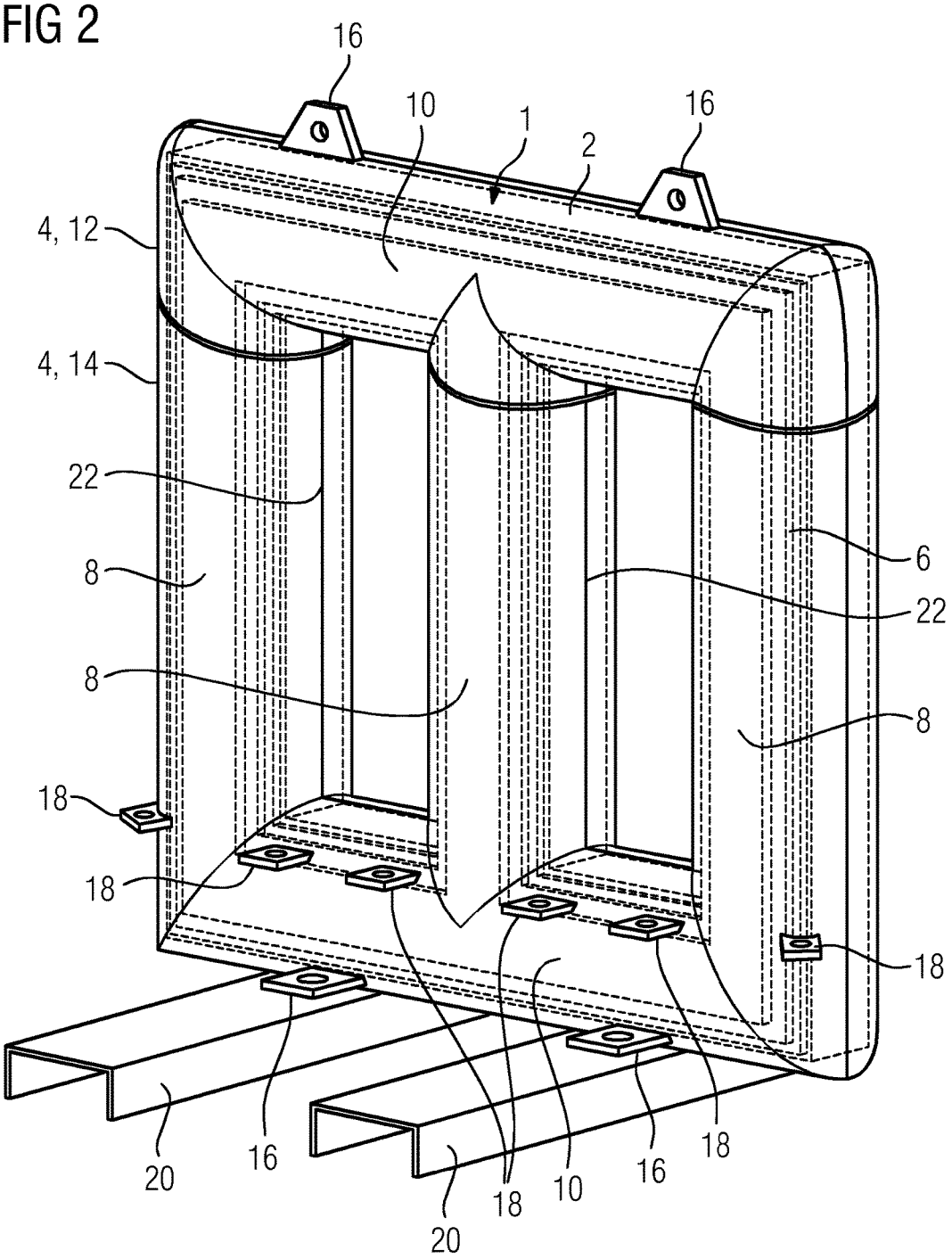
FIG. 2 a dry-type transformer core having a rounded housing which surrounds the iron core and which has a plurality of fastening devices.

FIG. 2 shows a dry-type transformer core 1 having a housing 4 with a likewise circular cross-section over the yokes 10 and limbs 8, which is shaped like the housing in FIG. 4. However, it additionally has fastening devices 16, 18 in the manner of eyes fastened externally to the housing 4. Fastening devices 16 are provided for fixing the dry-type transformer core 1 in position during the installation of the transformer, e.g. on brackets 20. Further fastening devices 18 serve to fix the windings (not illustrated) in position.

Figure 3:
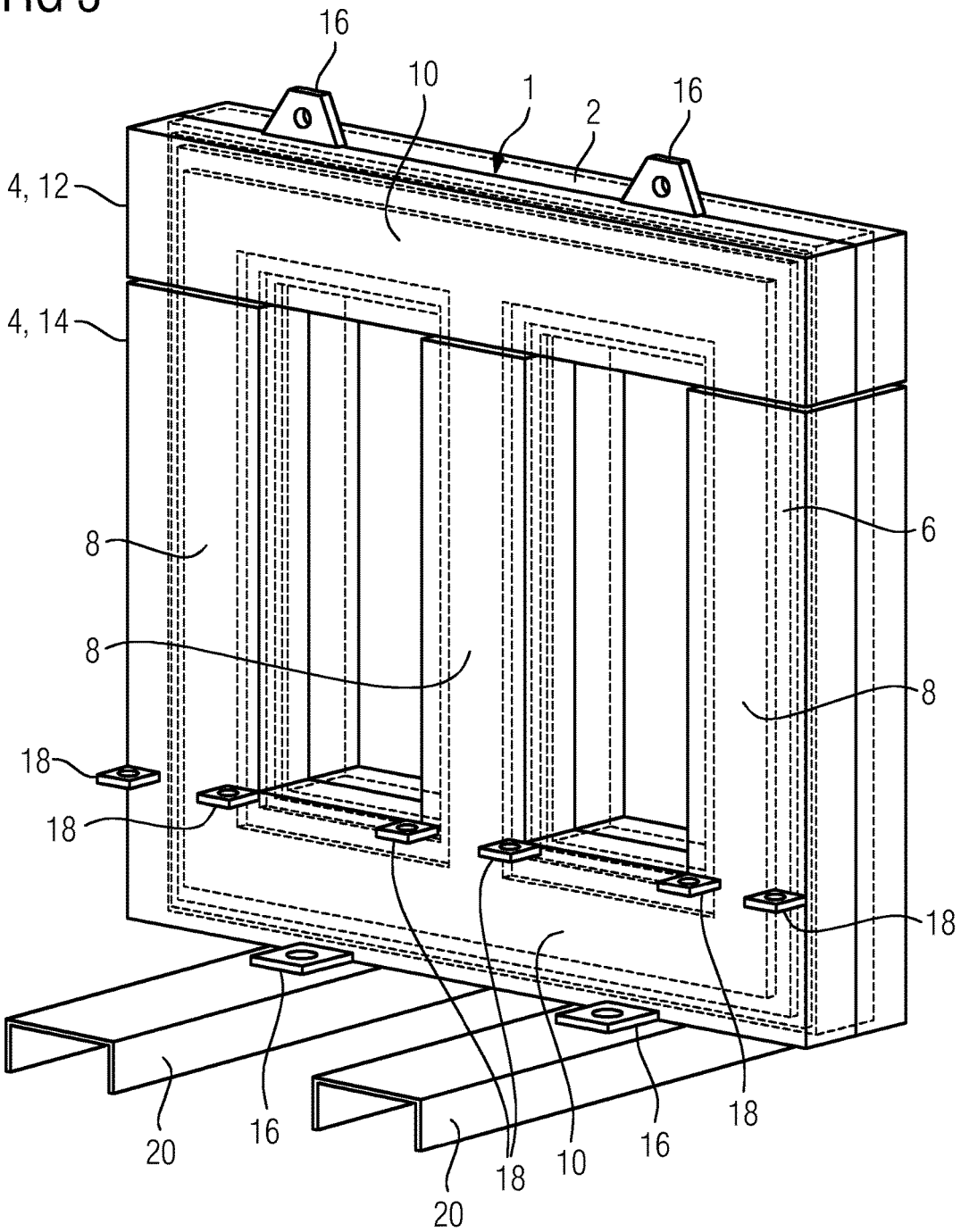
FIG. 3 a dry-type transformer core having a housing which is rectangular in terms of the limb cross-section, and which surrounds the iron core and which has a plurality of fastening devices.

In contrast to FIG. 1 and FIG. 3, the housing 4 in FIG. 2 is made of an electrically conductive material, e.g. the chrome-nickel steel mentioned above. The housing 4 is firstly grounded here. It furthermore comprises two insulating parts 22 (illustrated in FIG. 2), which are designed so that no closed conductor loops can occur around the iron core 2. In the exemplary embodiment of FIG. 2, the sides of the insulating parts 22 each form a rectangle, whereof the sides extend parallel to the axis of the respective limb 8 or yoke 10 on the inside, i.e. the face of the wall 4 which faces the adjacent limb 8 or yoke 10, and form a closed line here. The insulating parts 22 interrupt the otherwise conductive body of the housing 4 here. A flow of current in the wall 4 around the limbs 10 and yoke 8 is prevented here by the sides of the insulating parts 22.

FIG. 3 shows a dry-type transformer core 1, whereof the housing 4 has the same fastening devices 16, 18 as those in FIG. 2. However, the cross-section of the housing 4 over the yokes 10 and limbs 8 is rectangular.

The invention claimed is:

1. A dry-type transformer core, comprising:

an iron core having a plurality of limbs that are configured to be provided with a winding and a plurality of yokes connecting said limbs to one another;

a housing integrally formed on said iron core and surrounding said iron core in a substantially flush manner; and wherein clearance spaces between said iron core and said housing are filled with a material mass.

2. The dry-type transformer core according to claim 1, wherein said housing is non-magnetic.

3. The dry-type transformer core according to claim 1, wherein said housing has a mean relative permeability between −1.01 and 1.01.

4. The dry-type transformer core according to claim 3, wherein said housing has a mean relative permeability between −1.001 and 1.001.

5. The dry-type transformer core according to claim 1, wherein said housing has a wall with a wall thickness of less than 1 cm.

6. The dry-type transformer core according to claim 1, wherein said housing is predominantly made of a plastic material.

7. The dry-type transformer core according to claim 1, wherein said housing is predominantly made of steel.

8. The dry-type transformer core according to claim 1, wherein said housing is grounded.

9. The dry-type transformer core according to claim 1, wherein said housing is constructed from a plurality of parts, and wherein one of said parts substantially surrounds one of said yokes.

10. The dry-type transformer core according to claim 1, wherein said housing has a number of fastening devices on an outside thereof.

11. The dry-type transformer core according to claim 1, wherein said iron core consists of amorphous foils.

12. The dry-type transformer core according to claim 1, wherein said housing comprises an insulating part that is configured not to enable a closed conductor loop to be formed around said iron core.

13. A dry-type transformer, comprising:

a dry-type transformer core according to claim 1; and a plurality of coils wound around said limbs and surrounded by said housing.

14. The dry-type transformer according to claim 13, configured for a nominal voltage of greater than 1 kV.

15. The dry-type transformer according to claim 13, configured for a nominal power of greater than 50 kVA.

16. The dry-type transformer according to claim 13, configured for a nominal voltage of greater than 1 kV and a nominal power of greater than 50 kVA.

17. The dry-type transformer according to claim 13, being a cast resin transformer.

18. The dry-type transformer core according to claim 1, wherein said housing is predominantly made of electrically conductive material and said housing further comprises an insulating part that is configured not to enable a closed conductor loop to be formed around said iron core.

19. The dry-type transformer core according to claim 18, wherein said limbs and said yokes extend substantially orthogonal relative to one another and said insulating part is a rectangular insulator extending along said limbs and said yoke on an inside of a rectangle formed by said limbs and yokes.

* * * * *